US010514144B2

(12) United States Patent
Yamamoto

(10) Patent No.: US 10,514,144 B2
(45) Date of Patent: Dec. 24, 2019

(54) VEHICLE LAMP

(71) Applicant: KOITO MANUFACTURING CO., LTD., Tokyo (JP)

(72) Inventor: Ippei Yamamoto, Shizuoka (JP)

(73) Assignee: KOITO MANUFACTURING CO., LTD., Minato-ku, Tokyo (JP)

( * ) Notice: Subject to any disclaimer, the term of this patent is extended or adjusted under 35 U.S.C. 154(b) by 42 days.

(21) Appl. No.: 16/007,318

(22) Filed: Jun. 13, 2018

(65) Prior Publication Data

US 2018/0363875 A1 Dec. 20, 2018

(30) Foreign Application Priority Data

Jun. 14, 2017 (JP) ..... 2017-116718

(51) Int. Cl.
*F21S 41/36* (2018.01)
*F21S 41/147* (2018.01)
*F21S 41/663* (2018.01)

(52) U.S. Cl.
CPC ..... *F21S 41/36* (2018.01); *F21S 41/147* (2018.01); *F21S 41/663* (2018.01)

(58) Field of Classification Search
CPC ..... F21S 41/36; F21S 41/663; F21S 41/147; F21S 41/148; F21S 41/321; F21S 41/33; F21S 41/255; F21S 41/333; F21S 41/686; F21S 41/04; F21S 41/43; F21S 41/19; F21S 41/24; F21S 41/68; F21S 41/692; F21S 41/335; F21S 41/47; F21W 2102/13; F21W 2102/135; F21W 2102/18; B60Q 1/04; B60Q 2200/30; F21Y 2115/10
See application file for complete search history.

(56) References Cited

U.S. PATENT DOCUMENTS

2001/0000448 A1* 4/2001 Suzuki ..... B60Q 1/12 362/512
2002/0089853 A1* 7/2002 Taniuchi ..... F21S 41/162 362/297
2004/0125610 A1* 7/2004 Lekson ..... F21S 2/005 362/487
2015/0062948 A1 3/2015 Otsubo

FOREIGN PATENT DOCUMENTS

JP 2015-50173 A 3/2015

* cited by examiner

*Primary Examiner* — Anh T Mai
*Assistant Examiner* — Fatima N Farokhrooz
(74) *Attorney, Agent, or Firm* — Sughrue Mion, PLLC

(57) ABSTRACT

A vehicle lamp includes a first reflector which reflects light emitted from a first light source to form a low-beam light distribution pattern, a second reflector which reflects light emitted from a second light source to form a high-beam additional light distribution pattern and includes a short distance reflecting surface provided at a closer position and a long distance reflecting surface provided at a farther position with respect to the second light source at a predetermined interval therebetween, a third light source which is arranged in front of the second reflector and turned on in a low-beam lighting mode, and a third reflector which is arranged in a gap between the short distance reflecting surface and the long distance reflecting surface and reflects light emitted from the third light source.

5 Claims, 7 Drawing Sheets

VEHICLE LAMP

CROSS-REFERENCE TO RELATED APPLICATIONS

The present application claims the benefit of priority of Japanese Patent Application No. 2017-116718, filed on Jun. 14, 2017, the content of which is incorporated herein by reference.

TECHNICAL FIELD

Aspects of the present invention relate to a parabolic vehicle lamp which is configured to selectively form a low-beam light distribution pattern and a high-beam light distribution pattern.

BACKGROUND

There has been known a so-called parabolic vehicle lamp which is configured to reflect light emitted from a light source toward a front of the lamp by a reflector so as to selectively form a low-beam light distribution pattern and a high-beam light distribution pattern.

JP-A-2015-50173 discloses a vehicle lamp includes a first reflector and a second reflector arranged in a direction intersecting with a front-rear direction of the lamp. The first reflector forms a low-beam light distribution pattern by reflecting light emitted from a first light source toward a front of the lamp. The second reflector forms a high-beam additional light distribution pattern by reflecting light emitted from a second light source toward the front of the lamp.

In the vehicle lamp disclosed in JP-A-2015-50173, the low-beam light distribution pattern is formed by turning on the first light source, and the high-beam additional light distribution pattern is additionally formed to the low-beam light distribution pattern by additional turning on the second light source, thereby forming a high-beam light distribution pattern.

In the above vehicle lamp, the first light source and the second light source are turned on and reflecting surfaces of the first reflector and second reflector appear to emit light in a high-beam lighting mode. However, since only the first light source is turned on and the second light source is not turned on in a low-beam lighting mode, the reflecting surface of the first reflector appears to emit light and the reflecting surface of the second reflector does not appear to emit light, which deteriorates the visibility of the vehicle lamp.

SUMMARY

The present invention has been made in view of the above circumstances, and an aspect thereof provides a parabolic vehicle lamp which is configured to selectively form a low-beam light distribution pattern and a high-beam light distribution pattern and can improve visibility even in a case where a first reflector for forming the low-beam light distribution pattern and a second reflector for forming a high-beam additional light distribution pattern are arranged in a direction intersecting with a front-rear direction of the lamp.

An aspect of the present invention provides a vehicle lamp which further includes a predetermined third light source and a predetermined third reflector.

According to an embodiment of the present invention, there is provided a vehicle lamp including: a first light source; a first reflector configured to reflect light emitted from the first light source toward a front of the lamp to form a low-beam light distribution pattern; a second light source; a second reflector configured to reflect light emitted from the second light source toward the front of the lamp to form a high-beam additional light distribution pattern, wherein the first reflector and the second reflector are arranged in a direction intersecting with a front-rear direction of the lamp, and the second reflector includes a short distance reflecting surface provided at a closer position and a long distance reflecting surface provided at a farther position with respect to the second light source at a predetermined interval therebetween; a third light source arranged in front of the second reflector and configured to be turned on in a low-beam lighting mode; and a third reflector arranged in a gap between the short distance reflecting surface and the long distance reflecting surface and configured to reflect light emitted from the third light source toward the front of the lamp.

The "high-beam additional light distribution pattern" refers to a light distribution pattern additionally formed to the low-beam light distribution pattern so as to form a high-beam light distribution pattern.

A specific direction of the "direction intersecting with the front-rear direction of the lamp" is not particularly limited. For example, a vehicle width direction, an upper-lower direction, or the like may be adopted.

The type of each of the "first light source", the "second light source" and the "third light source" is not particularly limited. For example, a light emitting element such as a light emitting diode or a laser diode, a bulb light source, or the like may be adopted.

The number of the "first light source" and the "first reflector" and the number of the "second light source" and the "second reflector" are not particularly limited.

As long as the "second reflector" includes a short distance reflecting surface provided at a closer position and a long distance reflecting surface provided at a farther position with respect to the first light source at a predetermined interval therebetween, a specific positional relationship between the "short distance reflecting surface" and the "long distance reflecting surface" and the specific size and shape of the "gap" therebetween are not particularly limited, and the "gap" may be one place or several places.

As long as the "third reflector" is arranged in the gap between the short distance reflecting surface and the long distance reflecting surface and configured to reflect the light emitted from the third light source toward the front of the lamp, the specific size thereof, the shape of the reflecting surface, or the like are not particularly limited.

According to the above configuration, the vehicle lamp includes the first reflector configured to reflect the light emitted from the first light source toward the front of the lamp to form the low-beam light distribution pattern and the second reflector configured to reflect light emitted from the second light source toward the front of the lamp to form the high-beam additional light distribution pattern. The first reflector and the second reflector are arranged in the direction intersecting with the front-rear direction of the lamp. The second reflector includes the short distance reflecting surface provided at the closer position and the long distance reflecting surface provided at the farther position with respect to the second light source at the predetermined interval therebetween. The vehicle lamp further includes the third light source arranged in front of the second reflector and configured to be turned on in the low-beam lighting mode and the third reflector arranged in the gap between the short distance reflecting surface and the long distance reflecting surface and configured to reflect light emitted from the third light source toward the front of the lamp. Accordingly, the following operational effects can be obtained.

That is, in a high-beam lighting mode, since the first light source and the second light source are turned on, the reflecting surface of the first reflector appears to emit light, and the short distance reflecting surface and the long distance reflecting surface of the second reflector appear to emit light. In the low-beam lighting mode, since not only the first light source but also the third light source is turned on at the same time in contrast to the conventional case, not only the reflecting surface of the first reflector but also the reflecting surface of the third reflector (that is, a part of the gap between the short distance reflecting surface and the long distance reflecting surface of the second reflector) appears to emit light. Therefore, the visibility of the vehicle lamp can be improved.

According to the above configuration, the parabolic vehicle lamp is configured to selectively form the low-beam light distribution pattern and the high-beam light distribution pattern and can improve visibility even in a case where the first reflector for forming the low-beam light distribution pattern and the second reflector for forming the high-beam additional light distribution pattern are arranged in the direction intersecting with the front-rear direction of the lamp.

In the above configuration, if the third light source is arranged at a position which does not block the light emitted from the second light source reflected by the short distance reflecting surface and the long distance reflecting surface, the brightness of the high-beam additional light distribution pattern cannot be inadvertently lowered due to the presence of the third light source.

In the above configuration, if the reflecting surface of the third reflector is configured to reflect the light emitted from the third light source as downward light, the reflected light from the third reflector cannot become glare light when the third light source is turned on.

Alternatively, the reflecting surface of the third reflector may be configured to reflect the light emitted from the third light source as light including upward light which does not become glare light.

In the above configuration, if the reflecting surface of the third reflector is arranged at a position where the light emitted from the second light source is not incident on the reflecting surface, the reflection control function of the light emitted from the second light source by the short distance reflecting surface and the long distance reflecting surface of the second reflector is not affected, and reflection control on the light emitted from the third light source can be performed by the third reflector.

In the above configuration, if a fourth reflector which reflects the light emitted from the third light source toward the front of the lamp is arranged in front of the second light source, the peripheral region of the second reflector can be made appear to emit light over a wider range in the low-beam lighting mode. Further, the fourth reflector allows to prevent the second light source from being seen from the front of the lamp, so that the appearance of the vehicle lamp can be improved.

BRIEF DESCRIPTION OF DRAWINGS

FIG. 4A is a view showing a low-beam light distribution pattern, and FIG. 4B is a view showing a high-beam light distribution pattern.

FIG. 5A is a view showing a lighting state in a low-beam lighting mode, FIG. 5B is a view showing a lighting state in a high-beam lighting mode, and FIG. 5C is a view showing a modification of the lighting state in the high-beam lighting mode.

DESCRIPTION OF EMBODIMENTS

Figure 1:
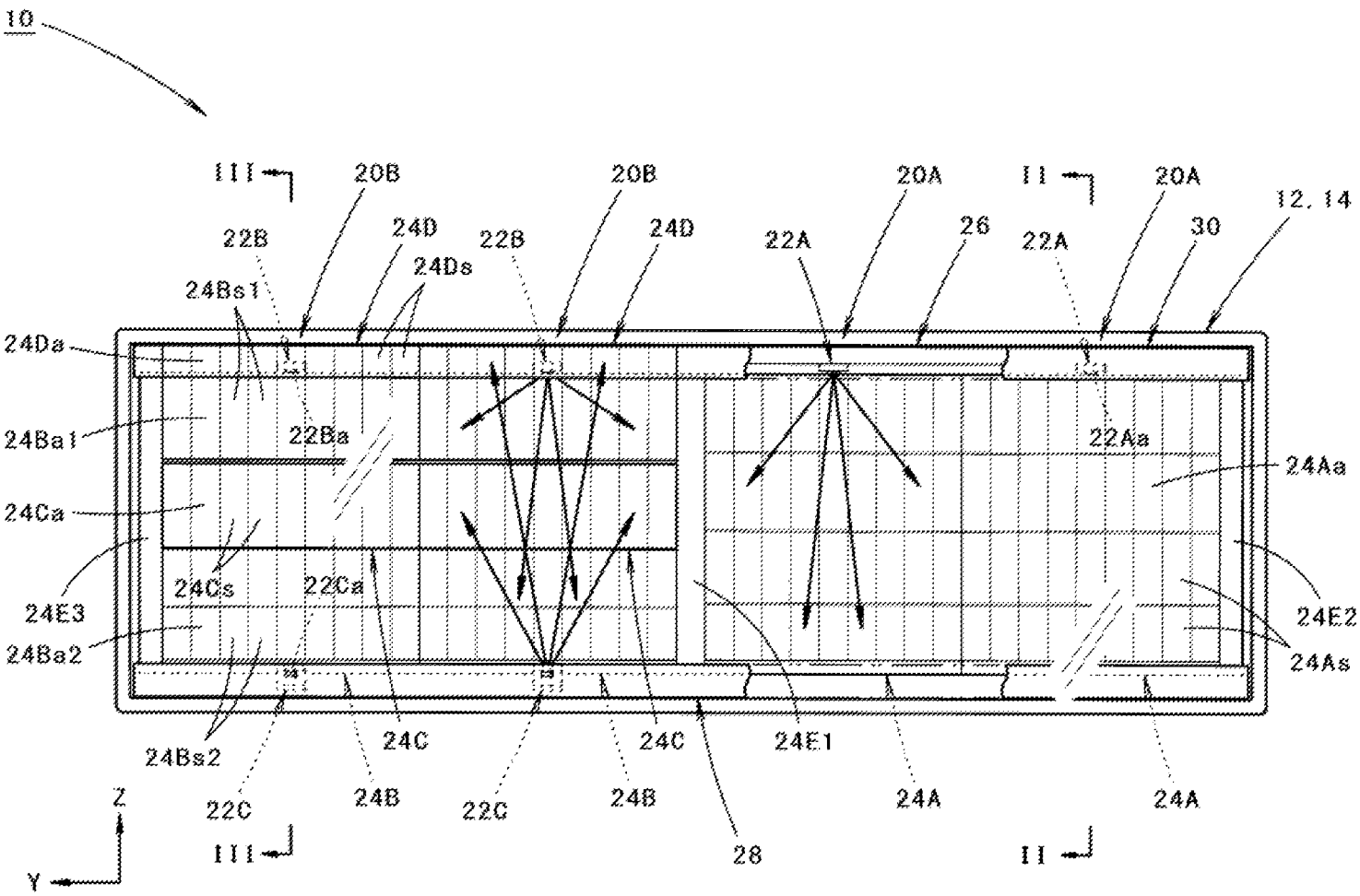
FIG. 1 is a partially cross-sectional front view showing a vehicle lamp according to an embodiment of the present invention.

Hereinafter, embodiments of the present invention will be described while referring to the drawings.

Figure 2:
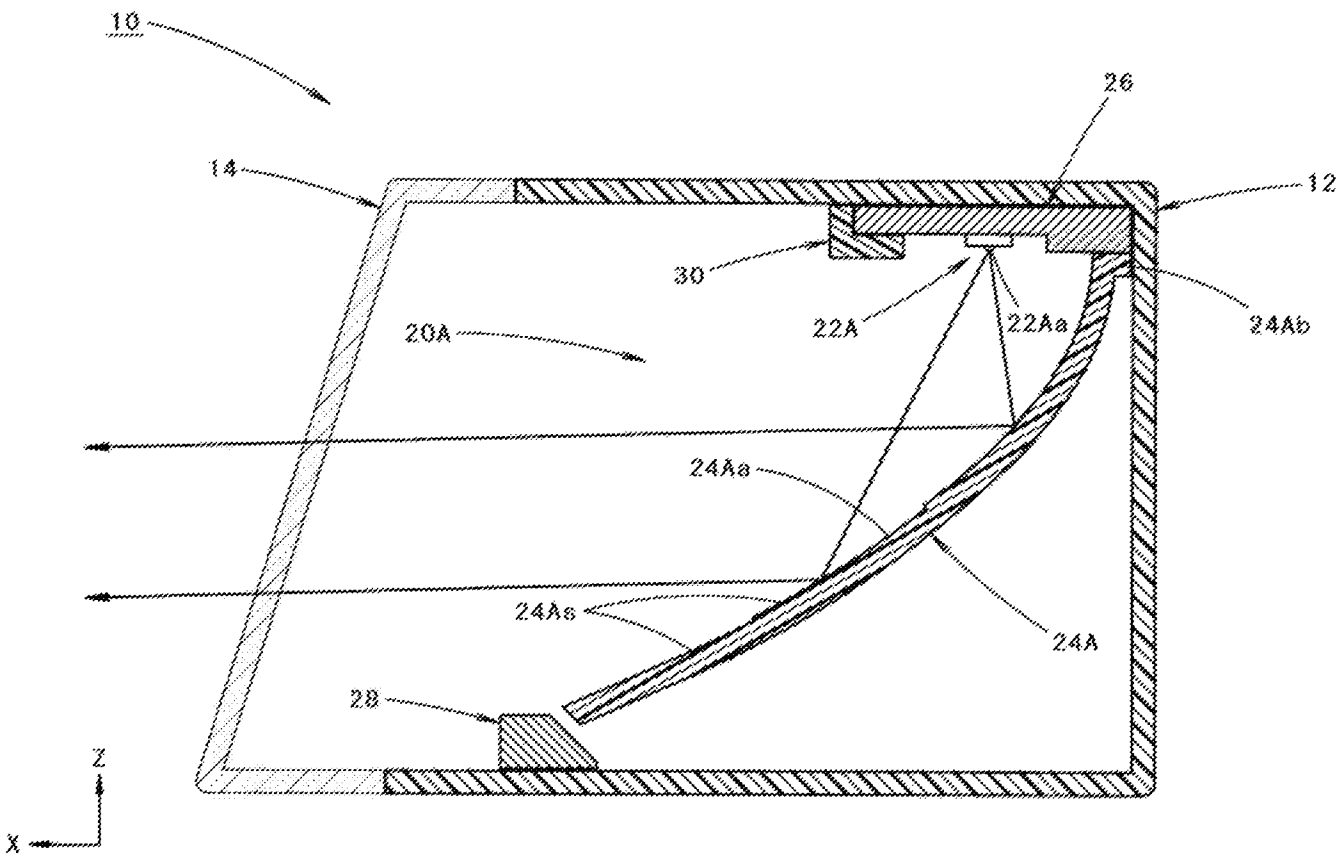
FIG. 2 is a cross-sectional view taken along a line II-II in FIG. 1.
Figure 3:
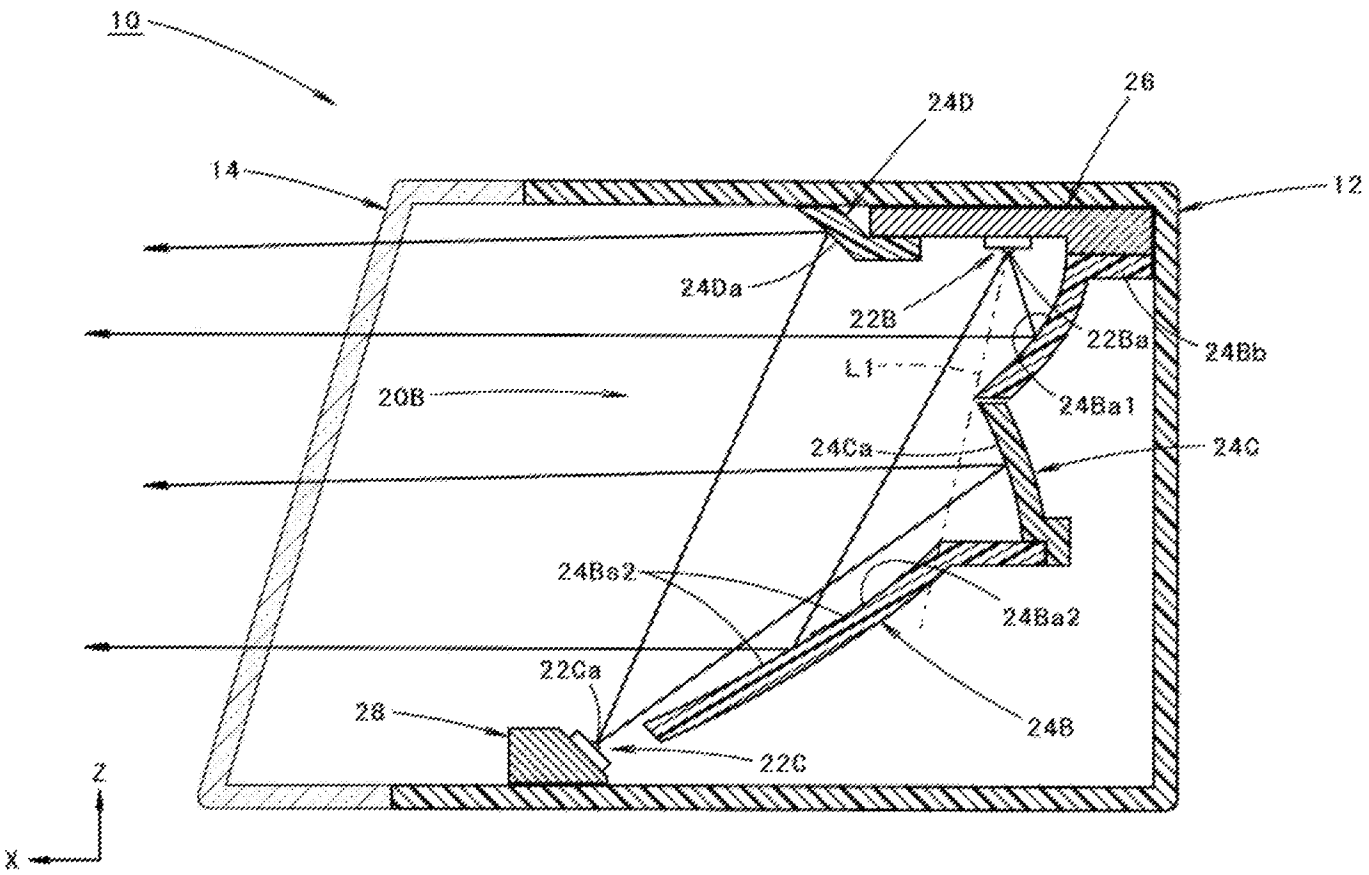
FIG. 3 is a cross-sectional view taken along a line III-III in FIG. 1.

FIG. 1 is a partially cross-sectional front view showing a vehicle lamp 10 according to an embodiment of the present invention. FIG. 2 is a cross-sectional view taken along a line II-II in FIG. 1, and FIG. 3 is a cross-sectional view taken along a line III-III in FIG. 1.

As shown in these drawings, the vehicle lamp 10 according to the present embodiment is a head lamp which is arranged on a front left end portion of a vehicle and is configured to selectively perform low-beam irradiation and high-beam irradiation.

The vehicle lamp 10 is configured such that four lamp units 20A, 20B are arranged in a vehicle width direction and accommodated in a lamp chamber formed by a lamp body 12 and a light-transmitting cover 14 attached to a front end opening thereof.

Incidentally, in these drawings, a direction represented by X is a "front side" of the lamp (also a vehicle "front side"), a direction represented by Y is a "right side", and a direction represented by Z is an "upper side".

Among the four lamp units 20A, 20B, two lamp units 20A positioned on a left side (that is, on an outer side in the vehicle width direction) are configured as lamp units for forming a low-beam light distribution pattern, and two lamp units 20B positioned on a right side are configured as lamp units for forming a high-beam additional light distribution pattern (that is, a light distribution pattern additionally formed to the low-beam light distribution pattern so as to form a high-beam light distribution pattern).

At first, the configuration of the two lamp units 20A will be described.

As shown in FIGS. 1 and 2, each of the lamp units 20A includes a first light source 22A and a first reflector 24A which reflects light emitted from the first light source 22A forward.

The first light source 22A is a white-light emitting diode and includes a light emitting surface 22Aa in a horizontally long rectangular shape.

The first light source 22A is supported on a lower surface of a substrate 26 with the light emitting surface 22Aa thereof facing downward. The substrate 26 has a function of a heat sink and is supported on the lamp body 12.

The first reflector 24A is arranged on a lower side of the first light source 22A and is supported on the lower surface of the substrate 26 at a horizontal flange portion 24Ab formed at an upper end edge of a rear portion of the first reflector 24.

A reflecting surface 24Aa of the first reflector 24A is configured such that a reflecting element 24As is arranged to each of a plurality of segments which are partitioned laterally and longitudinally into a lattice shape in a front view of the lamp. Each of the reflecting elements 24As is configured by a concave curved surface with a paraboloid of revolution serving as a reference plane. The paraboloid of revolution has a focal point at a light emitting center of the first light source 22A and has a center axis extending along a front-rear direction of the lamp.

Further, in each of the lamp units 20A, a part of the low-beam light distribution pattern is formed by controlling the reflection of the light emitted from the first light source 22A in each of the plurality of reflecting elements 24As configuring the reflecting surface 24Aa of the first reflector 24A so as to form the low-beam light distribution pattern as a combined light distribution pattern.

Next, the configuration of the two lamp units 20B will be described.

As shown in FIGS. 1 and 3, each of the lamp units 20B includes a second light source 22B and a second reflector 24B which reflects light emitted from the second light source 22B forward.

The second light source 22B has the same configuration as the first light source 22A and is supported on the lower surface of the substrate 26 with a light emitting surface 22Ba thereof facing downward.

The second reflector 24B is arranged on a lower side of the second light source 22B and is supported on the lower surface of the substrate 26 at a horizontal flange portion 24Bb formed at the upper end edge of the rear portion of the second reflector 24B.

The second reflector 24B includes a short distance reflecting surface 24Ba1 provided at a closer position and a long distance reflecting surface 24Ba2 provided at a farther position with respect to the second light source 22B at a predetermined interval therebetween.

The short distance reflecting surface 24Ba1 is configured such that a reflecting element 24Bs1 is arranged to each of the plurality of segments which are partitioned into a longitudinally striped shape in the front view of the lamp. Each of the reflecting elements 24Bs1 is configured by a concave curved surface with a paraboloid of revolution serving as a reference plane. The paraboloid of revolution has a focal point at a light emitting center of the second light source 22B and has the center axis extending along the front-rear direction of the lamp.

The long distance reflecting surface 24Ba2 is configured such that a reflecting element 24Bs2 is allocated to each of the plurality of segments which are partitioned laterally and longitudinally into a lattice shape in the front view of the lamp. Each of the reflecting elements 24Bs2 is configured by a concave curved surface with a paraboloid of revolution serving as a reference plane. The paraboloid of revolution has the focal point at the light emitting center of the second light source 22B and has the center axis extending along the front-rear direction of the lamp.

A focal distance of the paraboloid of revolution serving as the reference plane of the long distance reflecting surface 24Ba2 is set to be longer than that of the paraboloid of revolution serving as the reference plane of the short distance reflecting surface 24Ba1. The long distance reflecting surface 24Ba2 is formed such that an upper end edge thereof is positioned on a straight line L1 connecting the light emitting center of the second light source 22B and a lower end edge of the short distance reflecting surface 24Ba1.

Further, in each of the lamp units 20B, a part of the high-beam additional light distribution pattern is formed by controlling the reflection of the light emitted from the second light source 22B in each of the plurality of reflecting elements 24Bs1 configuring the short distance reflecting surface 24Ba1 and each of the plurality of reflecting elements 24Bs2 configuring the long distance reflecting surface 24Ba2 of the second reflector 24B, so as to form a high-beam additional light distribution pattern as a combined light distribution pattern.

Thereafter, in each of the lamp units 20B, a third light source 22C which is turned on in a low-beam lighting mode is arranged in front of the second reflector 24B, and a third reflector 24C for reflecting light emitted from the third light source 22C forward is arranged in a gap between the short distance reflecting surface 24Ba1 and the long distance reflecting surface 24Ba2.

The third light source 22C is a white-light emitting diode whose output power is smaller than that of the first light source 22A and that of the second light source 22B and includes a light emitting surface 22Ca in a horizontally long rectangular shape. The third light source 22C is supported on an obliquely upward inclined surface of a substrate 28 with the light emitting surface 22Ca facing obliquely upward and rearward. The substrate 28 has a function of a heat sink and is supported on the lamp body 12.

The third light source 22C is arranged at a position where the light emitted from the second light source 22B and reflected by the short distance reflecting surface 24Ba1 and the long distance reflecting surface 24Ba2 is not blocked. Specifically, the third light source 22C is arranged so as to be positioned in the vicinity of a front of a lower end edge of the second reflector 24B, and the substrate 28 is arranged such that an upper surface thereof is positioned lower than a lower end edge of the long distance reflecting surface 24Ba2.

A reflecting surface 24Ca of the third reflector 24C is arranged at a position on which the light emitted from the second light source 22B is not incident. Specifically, the third reflector 24C is arranged such that the reflecting surface 24Ca is positioned in a rearward position with respect to the straight line L1. The third reflector 24C is supported on the second reflector 24B at a lower end portion thereof.

The reflecting surface 24Ca of the third reflector 24C is configured such that a reflecting element 24Cs is arranged to each of the plurality of segments which are partitioned into a longitudinally striped shape in the front view of the lamp. Each of the reflecting elements 24Cs is configured by a concave curved surface with a paraboloid of revolution serving as a reference plane. The paraboloid of revolution has a focal point at a light emitting center of the third light source 22C and has the center axis extending along the front-rear direction of the lamp. Each of the reflecting elements 24Cs is configured to reflect the light emitted from the third light source 22C as downward light.

Further, in each of the lamp units 20B, a fourth reflector 24D for reflecting the light emitted from the third light source 22C forward is arranged in front of the second light source 22B. Specifically, the fourth reflector 24D is supported on the substrate 26 in the vicinity of a front of the substrate 26.

The reflecting surface 24Da of the fourth reflector 24D is configured such that a reflecting element 24Ds is arranged to each of the plurality of segments which are partitioned into a longitudinally striped shape in the front view of the lamp. Each of the reflecting elements 24Ds is configured by the concave curved surface with a paraboloid of revolution serving as the reference plane. The paraboloid of revolution has the focal point at a light emitting center of the third light source 22C and has the center axis extending along the front-rear direction of the lamp. Each of the reflecting elements 24Ds is configured to reflect the light emitted from the third light source 22C as downward light.

As shown in FIG. 1, the first reflectors 24A of the two lamp units 20A are integrally formed to be arranged in the vehicle width direction, and the second reflectors 24B of the two lamp units 20B are also integrally formed to be arranged in the vehicle width direction. Further, the two first reflectors 24A and the two second reflectors 24B are also integrally formed through a partition wall 24E1, and end walls 24E2 and 24E3 are integrally formed at both end portions thereof in the vehicle width direction.

The third reflectors 24C of the two lamp units 20B are integrally formed to be arranged in the vehicle width direction, and the fourth reflectors 24D of the two lamp units 20B are integrally formed to be arranged in the vehicle width direction.

As shown in FIG. 1, the common substrate 26 supporting the first light source 22A of each of the lamp units 20A and the second light source 22B of each of the lamp units 20B is formed so as to elongate in the vehicle width direction. In the substrate 26, the parts supporting a horizontal flange portion 24Ab of each of the first reflectors 24A and a horizontal flange portion 24Bb of each of the second reflectors 24B are formed to be one step lower than and thicker than the parts supporting each of the first light sources 22A, each of the second light sources 22B and each of the fourth reflectors 24D.

A molding 30 which elongates in the vehicle width direction is arranged at front of the first light source 22A in each of the lamp units 20A. The molding 30 is integrally formed with the two fourth reflectors 24D and is supported on the substrate 26.

Further, the common substrate 28 supporting the third light source 22C of each of the lamp units 20B is formed so as to elongate in the vehicle width direction. The substrate 28 is formed so as to extend to a portion positioned at front of the two lamp units 20A.

Figure 4A:
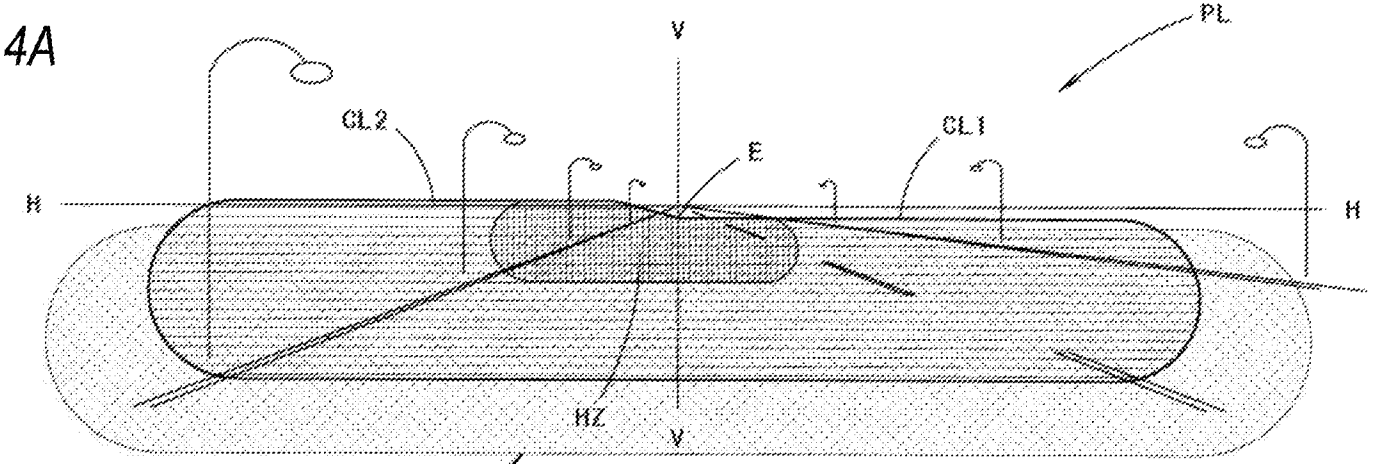
FIGS. 4A and 4B are perspective views showing light distribution patterns formed by light irradiated from the vehicle lamp, where
Figure 4B:
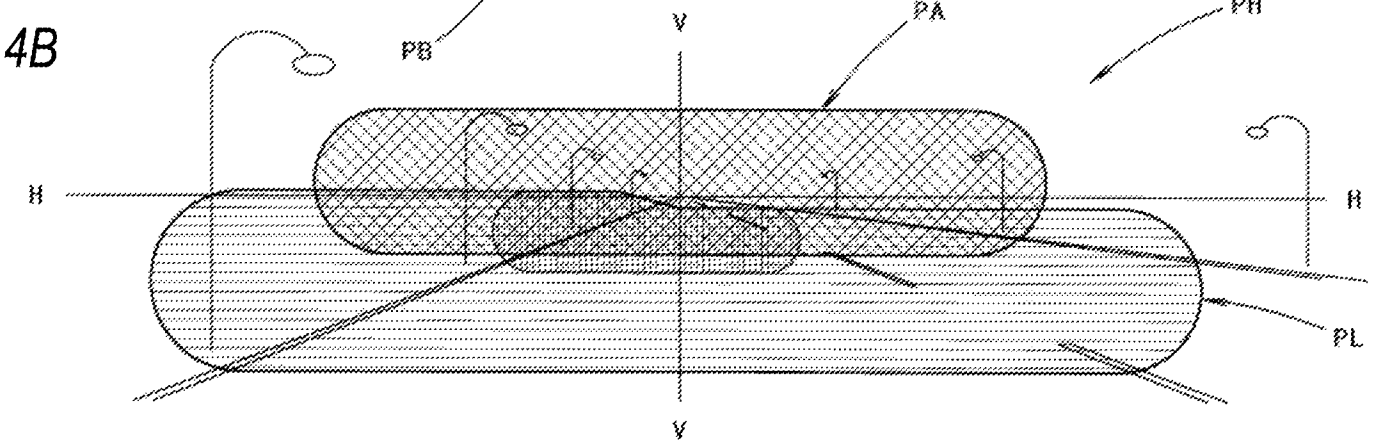

FIGS. 4A and 4B are perspective views showing light distribution patterns formed on a virtual vertical screen arranged 25 m in front of the lamp by light irradiated forward from the vehicle lamp 10. The light distribution pattern shown in FIG. 4A is a low-beam light distribution pattern PL, and the light distribution pattern shown in FIG. 4B1 is a high-beam light distribution pattern PH.

The low-beam light distribution pattern PL shown in FIG. 4A is formed as a combined light distribution pattern of two light distribution patterns formed by light irradiated from the two lamp units 20A.

The low-beam light distribution pattern PL is a low-beam light distribution pattern for left light distribution and an upper end edge thereof has cut-off lines CL1, CL2 which are formed in a left-right stepped manner. The cut-off lines CL1, CL2 extend in the horizontal direction in a left-right stepped manner and are bounded by a line V-V, which extends in a vertical direction to pass a vanishing point (i.e. H-V) in a lamp front direction. A portion on an oncoming vehicle lane side which is right of the line V-V is formed as a lower step cut-off line CL1, and a portion on an own vehicle lane side which is left of the line V-V is formed as an upper step cut-off line CL2, which is a step higher than the lower step cut-off line CL1 via an inclined portion.

In the low-beam light distribution pattern PL, an elbow point E which is an intersection point of the lower cut-off line CL1 and the V-V line is positioned about 0.5° to 0.6° below the HV. In this low-beam light distribution pattern PL, a horizontally long region surrounding a point positioned slightly to the left of the elbow point E is formed as a high luminous intensity region HZ.

In the low-beam light distribution pattern PL, a diffused light distribution pattern PB which widely spreads in the left-right direction around the line V-V is formed in a superposed manner below the cut-off lines CL1, CL2.

The diffused light distribution pattern PB is a light distribution pattern formed by the light emitted from the third light source 22C reflected by the reflecting surface 24Ca of the third reflector 24C and the reflecting surface 24Da of the fourth reflector 24D.

The diffused light distribution pattern PB is not positively intended to increase the brightness of the low-beam light distribution pattern PL. However, the diffused light distribution pattern PB increases the brightness of the low-beam light distribution pattern PL as a result.

The low-beam light distribution pattern PL is formed below the cut-off lines CL1, CL2 since reflected light from the reflecting surface 24Ca of the third reflector 24C and the reflecting surface 24Da of the fourth reflector 24D faces downward.

On the other hand, the high-beam light distribution pattern PH shown in FIG. 4B is formed as a combined light distribution pattern of the low-beam light distribution pattern PL and the high-beam additional light distribution pattern.

The high-beam additional light distribution pattern PA is formed as a combined light distribution pattern of two light distribution patterns formed by light irradiated from the two lamp units 20B. This high-beam additional light distribution pattern PA is formed so as to cross the cut-off lines CL1, CL2 vertically as a horizontally long light distribution pattern which spreads to the left and right sides around a point positioned slightly above the H-V.

Figures 5A, 5B, 5C:
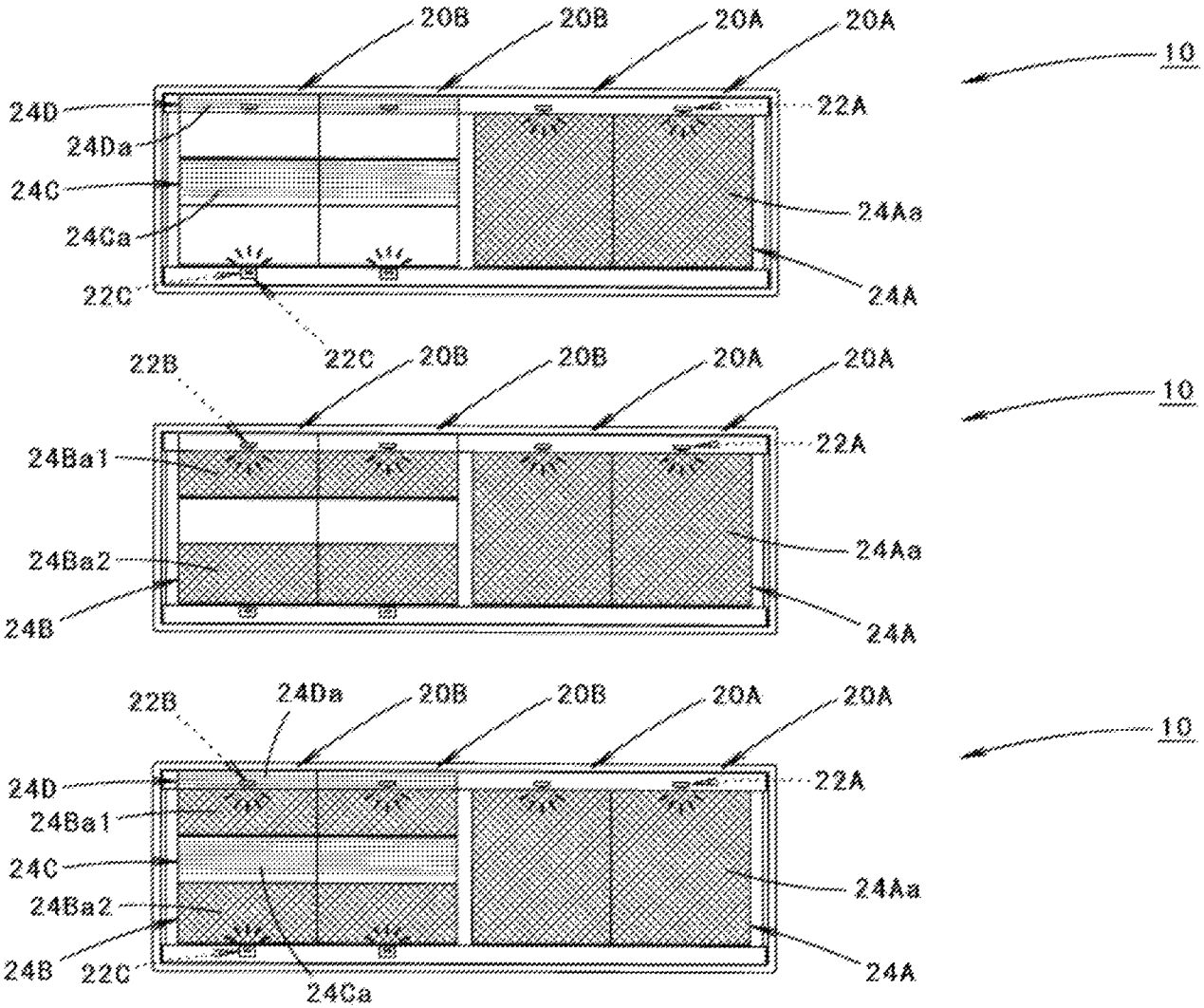
FIGS. 5A to 5C are front views showing the vehicle lamp in a lighting state, where

FIGS. 5A and 5B are front views showing the vehicle lamp 10 in a lighting state.

FIG. 5A is a view showing a lighting state in a low-beam lighting mode, and FIG. 5B is a view showing a lighting state in a high-beam lighting mode.

As shown in FIG. 5A, in the low-beam lighting mode, the first light sources 22A of the two lamp units 20A and the third light sources 22C of the remaining two lamp units 20B are turned on.

In each of the lamp units 20A, since reflected light from the first reflector 24A is irradiated forward by the lighting of the first light source 22A, the reflecting surface 24Aa thereof appears to emit light as a whole.

On the other hand, in each of the lamp units 20B, since reflected light from the third reflector 24C and the fourth reflector 24D is irradiated forward by the lighting of the third light source 22C, the reflecting surface 24Ca and the reflecting surface 24Da appear to emit light in a horizontally striped shape at intervals in the upper-lower direction.

As shown in FIG. 5B, in the high-beam lighting mode, the first light sources 22A of the two lamp units 20A maintain the lighting state, while the third light sources 22C of the remaining two lamp units 20B are turned off and the second light sources 22B thereof are turned on.

Accordingly, in each of the lamp units 20A, the reflecting surface 24Aa of the first reflector 24A appears to emit light as a whole, as in the case of the low-beam lighting mode.

On the other hand, in each of the lamp units 20B, since reflected light from the second reflectors 24B is irradiated forward by the lighting of the second light sources 22B, the short distance reflecting surface 24Ba1 and the long distance reflecting surface 24Ba2 appear to emit light in a horizontally striped shape at intervals in the upper-lower direction.

Next, the operational effect of the present embodiment will be described.

In the vehicle lamp 10 according to the present embodiment, the first reflector 24A which reflects the light emitted from the first light source 22A forward to form the low-beam light distribution pattern PL and the second reflector 24B which reflects the light emitted from the second light source 22B forward to form the high-beam additional light distribution pattern PA are arranged in the vehicle width direction (that is, the direction intersecting with the front-rear direction of the lamp). The second reflector 24B includes the short distance reflecting surface 24Ba1 provided at the closer position and the long distance reflecting surface 24Ba2 provided at the farther position with respect to the second light source 22B at the predetermined interval therebetween. The third light source 22C is arranged in front of the second reflector 24B and is turned on in the low-beam lighting mode, and the third reflector 24C is arranged in the gap between the short distance reflecting surface 24Ba1 and the long distance reflecting surface 24Ba2 and is arranged so as to reflect the light emitted from the third light source 22C forward. Accordingly, the following effects can be obtained.

That is, in the high-beam lighting mode, since the first light source 22A and the second light source 22B are turned on, the reflecting surface 24Aa of the first reflector 24A appears to emit light, and the short distance reflecting surface 24Ba1 and the long distance reflecting surface 24Ba2 of the second reflector 24B appear to emit light. In the low-beam lighting mode, since not only the first light source 22A but also the third light source 22C is turned on at the same time in contrast to the conventional case, not only the reflecting surface 24Aa of the first reflector 24A but also the reflecting surface 24Ca of the third reflector 24C (that is, a part of the gap between the short distance reflecting surface 24Ba1 and the long distance reflecting surface 24Ba2 of the second reflector 24B) appears to emit light. Therefore, the visibility of the vehicle lamp 10 can be improved.

According to the present embodiment, the parabolic vehicle lamp 10 is configured to selectively form the low-beam light distribution pattern PL and the high-beam light distribution pattern PH and can improve visibility even in a case where the first reflector 24A for forming the low-beam light distribution pattern PL and the second reflector 24B for forming the high-beam additional light distribution pattern PA are arranged in the direction intersecting with the front-rear direction of the lamp.

In the present embodiment, since the third light source 22C is arranged at a position which does not block the light emitted from the second light source 22B reflected by the short distance reflecting surface 24Ba1 and the long distance reflecting surface 24Ba2, the brightness of the high-beam additional light distribution pattern PA cannot be inadvertently lowered due to the presence of the third light source 2C.

In the above configuration, since the reflecting surface 24Ca of the third reflector 24C is configured to reflect the light emitted from the third light source 22C as downward light, the reflected light from the third reflector 24C cannot become glare light when the third light source 22C is turned on.

In the above configuration, since the reflecting surface 24Ca of the third reflector 24C is arranged at a position where the light emitted from the second light source 22B is not incident on the reflecting surface 24Ca, the reflection control function of the light emitted from the second light source 22B by the short distance reflecting surface 24Ba1 and the long distance reflecting surface 24Ba2 of the second reflector 24B is not affected, and reflection control on the light emitted from the third light source 22C can be performed by the third reflector 24C.

In the present embodiment, since the fourth reflector 24D which reflects the light emitted from the third light source 22C forward is arranged in front of the second light source 22B, in the low-beam lighting mode, the peripheral region of the second reflector 24B can be made appear to emit light over a wider range. Further, the fourth reflector 24B allows to prevent the second light source 22B from being seen from the front of the lamp, so that the appearance of the vehicle lamp 10 can be improved.

In the above embodiment, as shown in FIG. 5B, although it is described that the third light sources 22C of the two lamp units 20B are turned off and the second light sources 22B are turned on in the high-beam lighting mode, as shown in FIG. 5C, the third light sources 22C of the two lamp units 20B are not turned off and the second light sources 22B are additionally turned on in the high-beam lighting mode.

In such a configuration, in each of the lamp units 20B, not only the short distance reflecting surface 24Ba1 and the long distance reflection surface 24Ba2 of the second reflector 24B but also the reflecting surfaces 24Ca, 24Da of the third reflector 24C and the fourth reflector 24D can be made appear to emit light.

In the above embodiment, although it is described that the reflecting surface 24Ca of the third reflector 24C is configured to reflect the light emitted from the third light source 22C as downward light, the reflecting surface 24Ca of the third reflector 24C may be configured to reflect the light emitted from the third light source 22C as light including upward light which does not become glare light. In this case, the reflecting surface 24Ca may be configured as a reflecting surface close to the perfectly diffusing surface by embossing processing, frost processing or the like.

In the above embodiment, although it is described that the two lamp units 20A and the two lamp units 20B are arranged, the lamp units 20A and the lamp units 20B can be arranged in different numbers.

Next, a modified example of the above embodiment will be described.

Figure 6:
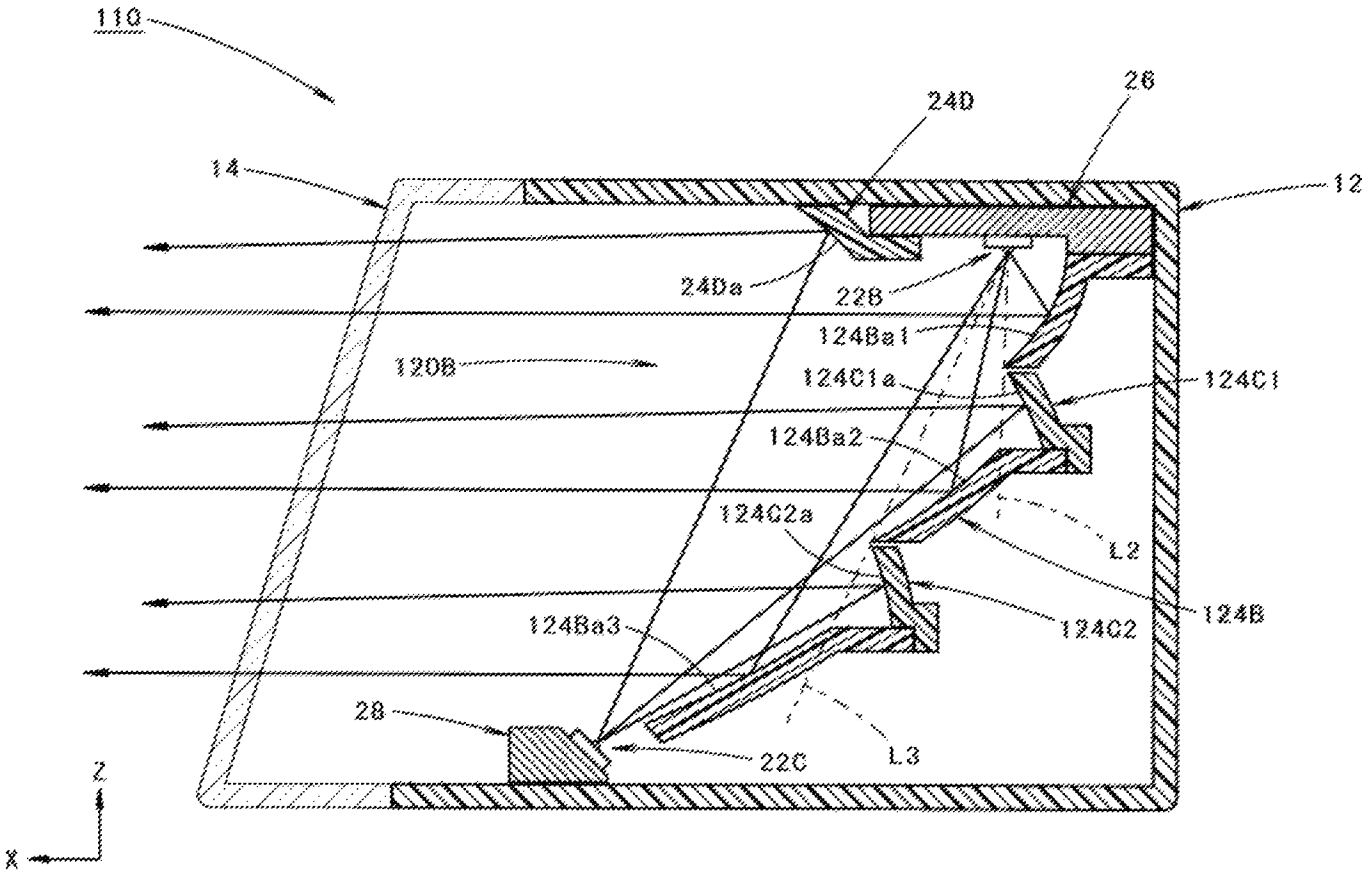
FIG. 6 is a view showing a modification of the above embodiment and corresponds to FIG. 3.

FIG. 6 is a view showing a vehicle lamp 110 according to the present modification and corresponds to FIG. 3.

As shown in the drawing, although the basic configuration of the vehicle lamp 110 is similar to that of the above embodiment, the configuration of each lamp unit 120B is partially different from that of the above embodiment.

In the present modification, a second reflector 124B of each of the lamp units 120B includes a first reflecting surface 124Ba1 provided at a closer position with respect to a second light source 22B, a second reflecting surface 124Ba2 provided at a farther position with respect to the first reflecting surface 124Ba1, and a third reflecting surface 124Ba3 provided at a still farther position with respect to the second reflecting surface 124Ba2 at predetermined intervals.

That is, in the present modification, in the relationship between the first reflecting surface 124Ba1 and the second reflecting surface 124Ba2, the first reflecting surface 124Ba1 configures a short distance reflecting surface and the second reflecting surface 124Ba2 configures a long distance reflecting surface, and in a relationship between the second reflecting surface 124Ba2 and the third reflecting surface 124Ba3, the second reflecting surface 124Ba2 configures a short distance reflecting surface and the third reflecting surface 124Ba3 configures a long distance reflecting surface.

Each of the first to third reflecting surfaces 124Ba1 to 124Ba3 is formed based on a paraboloid of revolution as a reference surface. The paraboloid of revolution has a focal point at a light emitting center of the second light source 22B and has a center axis extending along a front-rear direction of the lamp. A focal distance of the paraboloid of revolution is set to become longer in the order of the first to third reflecting surfaces 124Ba1 to 124Ba3.

The second reflecting surface 124Ba2 is formed such that an upper end edge thereof is positioned on a straight line L2 connecting a light emitting center of the second light source 22B and a lower end edge of the first reflecting surface 124Ba1, and the third reflecting surface 124Ba3 is formed such that an upper end edge thereof is positioned on a straight line L3 connecting the light emitting center of the second light source 22B and a lower end edge of the second reflecting surface 124Ba2.

Further, each of the lamp units 120B forms a part of the high-beam additional light distribution pattern by controlling the reflection of light emitted from the second light source 22B in each of the first reflecting surface 124Ba1 to the third reflecting surface 124Ba3 of the second reflector 124B so as to form the high-beam additional light distribution pattern as a combined light distribution pattern.

In each of the lamp units 120B, a third reflector 124C1 and a third reflector 124C2 for reflecting light emitted from a third light source 22C forward are arranged in a gap between the first reflecting surface 124Ba1 and the second reflecting surface 124Ba2 and in a gap between the second reflecting surface 124Ba2 and the third reflecting surface 124Ba3 of the second reflector 124B, respectively.

A reflecting surface 124C1*a* of the third reflector 124C1 and a reflecting surface 124C2*a* of the third reflector 124C2 are arranged at positions on which the light emitted from the second light source 22B is not incident. Specifically, the third reflector 124C1 is arranged such that the reflecting surface 124C1*a* thereof is positioned in a rearward position with respect to the straight line L2, and the third reflector 124C2 is arranged such that the reflecting surface 124C2*a* thereof is positioned in a rearward position with respect to the straight line L3. Each of the third reflectors 124C1, 124C2 is supported on the second reflector 124B at a lower end portion thereof.

The reflecting surface 124C1*a* of the third reflector 124C1 and the reflecting surface 124C2*a* of the third reflector 124C2 are formed based on a paraboloid of revolution as a reference surface. The paraboloid of revolution has a focal point at a light emitting center of the third light source 22C and has the center axis extending along the front-rear direction of the lamp. A focal distance of the paraboloid of revolution is set to become shorter in the order of the reflecting surface 124C1*a* to the third reflecting surface 124C2*a*. Then, each of the reflecting surfaces 124C1*a*, 124C2*a* is configured to reflect the light emitted from the third light source 22C as downward light.

Figures 7A, 7B, 7C:
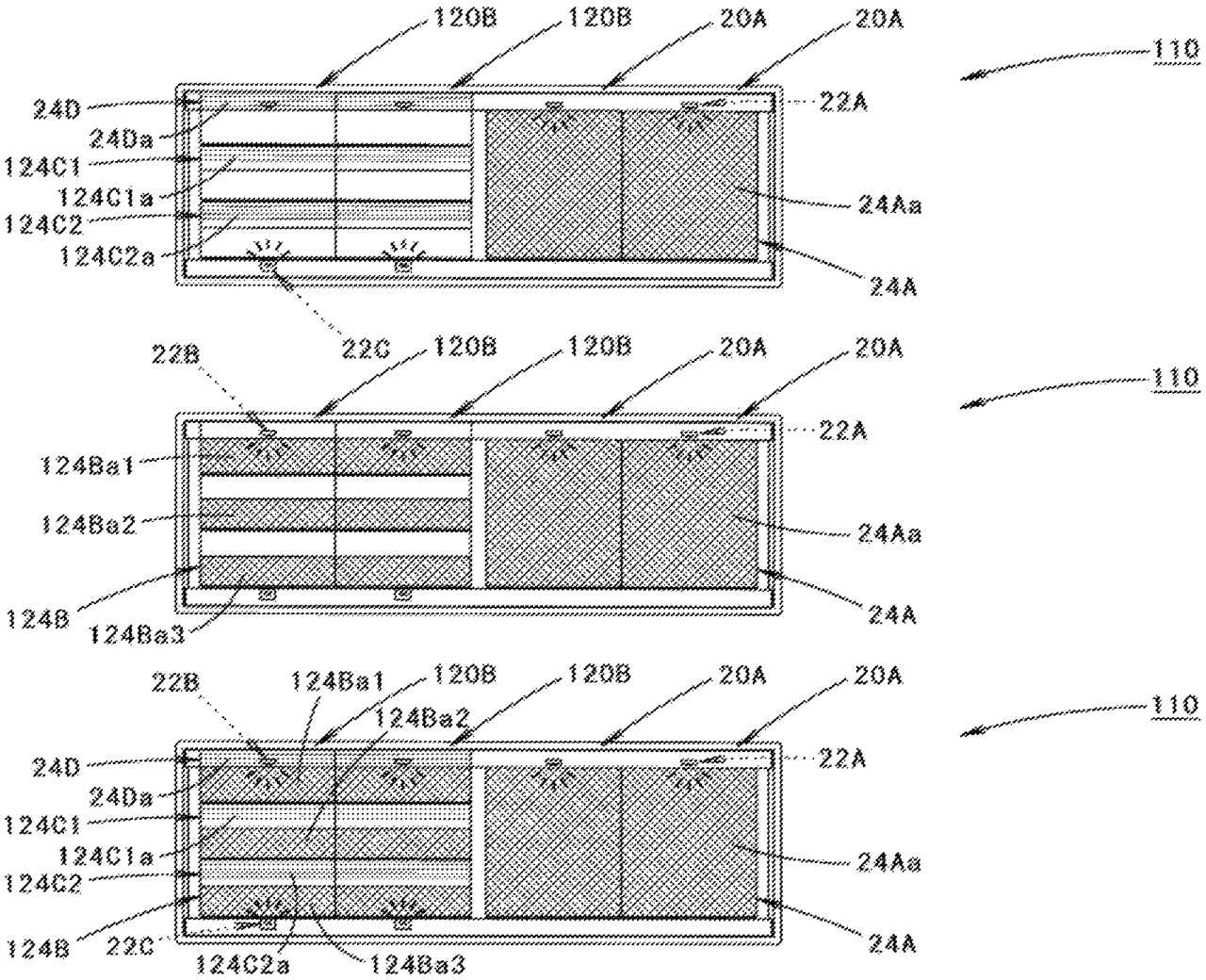
FIGS. 7A to 7C are views showing the function of the above modification and corresponds to FIGS. 5A to 5C.

FIGS. 7A and 7B are front views showing the vehicle lamp 110 in a lighting state.

FIG. 7A is a view showing a lighting state in a low-beam lighting mode, and FIG. 7B is a view showing a lighting state in a high-beam lighting mode.

As shown in FIG. 7A, in the low-beam lighting mode, the first light sources 22A of the two lamp units 20A and the third light sources 22C of the two lamp units 120B are turned on, as in the case of the above embodiment.

At this time, in each of the lamp units 20A, a reflecting surface 24Aa of the first reflector 24A appears to emit light as a whole by the lighting of the first light source 22A.

On the other hand, in each of the lamp units 120B, since reflected light from each of the third reflectors 124C1, 124C2 and reflected light from the fourth reflector 24D are irradiated forward by the lighting of the third light source 22C, the reflecting surfaces 124C1*a*, 124C2*a* and the reflecting surface 24Da appear to emit light in a horizontally striped shape at intervals in an upper-lower direction.

As shown in FIG. 7B, in the high-beam lighting mode, the first light sources 22A of the two lamp units 20A maintain the lighting state, while the third light sources 22C of the two lamp units 120B are turned off and the second light sources 22B are turned on, as in the case of the above embodiment.

Accordingly, in each of the lamp units 20A, the reflecting surface 24Aa of the first reflector 24A appears to emit light as a whole.

On the other hand, in each of the lamp units 120B, reflected light from the second reflector 124B is irradiated forward by the lighting of the second light source 22B, so that the first to third reflecting surfaces 124Ba1 to 124Ba3 appear to emit light in a horizontally striped shape at intervals in the upper-lower direction.

In the present modification, the third light source 22C is turned on in the low-beam lighting mode, the reflecting surface 124Ca1 of the third reflector 124C1 and the reflecting surface 124C2*a* of the third reflector 124C2 (that is, a part of a gap between the first reflecting surface 124Ba1 and the second reflecting surface 124Ba2 of the second reflector 124B and a part of a gap between the second reflecting surface 124Ba2 and the third reflecting surface 124Ba3) also appear to emit light. Therefore, the visibility of the vehicle lamp 110 can be further improved as compared with the case of the above embodiment.

In the above modification, although it is described that the third light sources 22C of the two lamp units 120B are turned off and the second light sources 22B are turned on in the high-beam lighting mode as shown in FIG. 7B, the third light sources 22C of the two lamp units 120B may be not turned off and the second light sources 22B are additionally turned on in the high-beam lighting mode as shown in FIG. 7C.

Incidentally, the numerical values shown as the specifications in the above embodiment and the modification thereof are merely examples, and these values may be set to different values as appropriate.

Further, the present invention is not limited to the configurations described in the above embodiment and the modification thereof, and a configuration added with various other changes may be adopted.

The invention claimed is:

1. A vehicle lamp comprising:

a first light source;

a first reflector configured to reflect light emitted from the first light source toward a front of the lamp to form a low-beam light distribution pattern;

a second light source;

a second reflector configured to reflect light emitted from the second light source toward the front of the lamp to form a high-beam additional light distribution pattern, wherein the first reflector and the second reflector are aligned in a vehicle width direction or a vertical direction, and the second reflector includes a short distance reflecting surface provided at a closer position and a long distance reflecting surface provided at a farther position with respect to the second light source at a predetermined interval therebetween;

a third light source arranged in front of the second reflector and configured to be turned on in a low-beam lighting mode; and a third reflector arranged in a gap between the short distance reflecting surface and the long distance reflecting surface and configured to reflect light emitted from the third light source toward the front of the lamp.

2. The vehicle lamp according to claim 1, wherein the third light source is arranged at a position which does not block the light emitted from the second light source reflected by the short distance reflecting surface and the long distance reflecting surface.

3. The vehicle lamp according to claim 1, wherein a reflecting surface of the third reflector is configured to reflect the light emitted from the third light source as downward light.

4. The vehicle lamp according to claim 1, wherein a reflecting surface of the third reflector is arranged at a position where the light emitted from the second light source is not incident on the reflecting surface.

5. The vehicle lamp according to claim 1, further comprising:

a fourth reflector arranged in front of the second light source and configured to reflect the light emitted from the third light source toward the front of the lamp.

* * * * *